US011133145B2

(12) United States Patent
Menon

(10) Patent No.: US 11,133,145 B2
(45) Date of Patent: Sep. 28, 2021

(54) DRAW-OUT CURRENT LIMITING FUSE

(71) Applicant: ABB Power Grids Switzerland AG, Baden (CH)

(72) Inventor: Suresh Menon, Auckland (NZ)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/237,218

(22) Filed: Dec. 31, 2018

(65) Prior Publication Data

US 2019/0371559 A1 Dec. 5, 2019

Related U.S. Application Data

(60) Provisional application No. 62/612,399, filed on Dec. 30, 2017.

(51) Int. Cl.

| | |
|---|---|
| ***H01H 85/055*** | (2006.01) |
| ***H01H 85/48*** | (2006.01) |
| ***H01F 27/40*** | (2006.01) |
| ***H01H 85/143*** | (2006.01) |
| ***H01H 85/042*** | (2006.01) |
| *H01H 85/175* | (2006.01) |

(52) U.S. Cl.

CPC ..... *H01H 85/055* (2013.01); *H01F 27/40* (2013.01); *H01H 85/042* (2013.01); *H01H 85/143* (2013.01); *H01H 85/48* (2013.01); *H01H 85/1755* (2013.01); *H01H 85/485* (2013.01)

(58) Field of Classification Search

CPC ..... H01H 85/055; H01H 85/48; H01H 2085/0291; H01H 85/143; H01H 85/042; H01H 85/485; H01H 85/1755; H01H 85/17; H01H 85/165; H01H 85/0013; H01F 27/40; H05K 5/0095; H05K 5/0239; H05K 5/0004

USPC ..... 337/159, 161, 204

See application file for complete search history.

(56) References Cited

U.S. PATENT DOCUMENTS 3,475,693 A * 10/1969 Ristuccia Donald J ..... H01H 9/102 337/207

3,628,092 A * 12/1971 Keto ..... H01F 27/402 361/41

3,732,517 A * 5/1973 Keto ..... H01H 9/102 337/278

3,792,215 A * 2/1974 Keto ..... H01H 33/76 218/90

(Continued)

*Primary Examiner* — Stephen S Sul

(74) *Attorney, Agent, or Firm* — Sage Patent Group

(57) ABSTRACT

A current-limiting fuse for an electronic apparatus, such as, for example, a transformer. The fuse can be withdrawable under a liquid insulating medium, such as oil, and is capable of being replaceable in the field. The fuse can include a fuse element that is encased within an electrically insulative sheath. Additionally, a plurality of contact blades can extend from a lower portion of the fuse and be securely engaged with contact clips that are in electrical communication with one or more components of the electronic apparatus. The contact blades can be positioned within a dielectric insulating medium while a reminder of the fuse between the contact blades and the enclosure can be positioned within an air gap. Further, the contact blades can accommodate seating of the fuse within the enclosure and/or an associated canister.

22 Claims, 8 Drawing Sheets

(56) References Cited

U.S. PATENT DOCUMENTS

| | | | | | |
|---|---|---|---|---|---|
| 3,916,364 | A * | 10/1975 | Cooper | H01H 85/02 | 337/217 |
| 4,321,576 | A * | 3/1982 | Lien | H01H 9/30 | 337/202 |
| 4,625,196 | A * | 11/1986 | Muench | H01H 85/143 | 337/204 |
| 4,743,996 | A * | 5/1988 | Book | H01H 85/44 | 337/31 |
| 5,227,758 | A * | 7/1993 | Ranjan | H01H 9/102 | 337/204 |
| 7,327,213 | B2 * | 2/2008 | Martin | H01H 85/042 | 174/127 |
| 2012/0032772 | A1 * | 2/2012 | Smith | H01H 33/55 | 337/207 |
| 2014/0055227 | A1 * | 2/2014 | Boe | H01H 85/0026 | 337/1 |
| 2014/0374132 | A1 * | 12/2014 | Boe | H01H 85/0013 | 174/50.51 |
| 2017/0053767 | A1 * | 2/2017 | Scott | H01B 9/003 | |

* cited by examiner

DRAW-OUT CURRENT LIMITING FUSE

CROSS REFERENCE TO RELATED APPLICATIONS

The present application claims the benefit of U.S. Provisional Patent Application Ser. No. 62/612,399, which was filed on Dec. 30, 2017, and is incorporated herein by reference in its entirety.

BACKGROUND

Embodiments of the present invention generally relate to draw-out current limiting fuses. More particularly, but not exclusively, embodiments of the present invention relate to current-limiting fuses that are capable of being withdrawn from an electronic apparatus under dielectric fluid.

Liquid-filled distribution transformers, including, for example, ANSI market distribution transformers, often use current-limiting fuses that are positioned under a dielectric fluid, such as, for example, oil. Traditionally, such fuses can be difficult to replace in the field. Moreover, due to at least hardwired connections inside the transformer tank, replacement of at least some current-limiting fuses typically requires that the transformer be disconnected and moved to a repair shop. Additionally, such replacement can also involve draining at least some of the dielectric fluid from the transformer.

Alternatively, certain applications that require in-field replacement of current-limiting fuses can utilize canister fuses. Such canister fuses typically have a fuse body that is mounted in a dry well. While dry well canister applications can allow for a blown fuse to be draw out, and replaced, without draining dielectric fluid from the transformer, such canister applications can be limited in their application. For example, with respect to high voltage applications, the presence of the canister fuses in air can render such fuses susceptible to arcing. Additionally, both the fuse and the dry well can be sensitive to contamination.

BRIEF SUMMARY

An aspect of the present application is a draw-out fuse that can include a sheath comprising an insulative material, and a fuse element that is encased within the sheath. The fuse element can include a sacrificial element that melts in response to overcurrent and opens at least a portion of a circuit that extends across the draw-out fuse. The draw-out fuse can also include a plurality of contact blades that are in electrical communication with the fuse element, and which extend outwardly from at least the sheath.

Another aspect of the present application is an apparatus that can include a fuse comprising a fuse element that is encased within a sheath. The sheath can comprise an electrically insulative material. Further, the fuse element can include a sacrificial element that melts in response to overcurrent and opens at least a portion of a circuit that extends across the fuse. The fuse can further include a plurality of contact blades that are in electrical communication with the fuse element, and which extend outwardly from at least the sheath. The apparatus can further include a plurality of contact clips, each of the plurality of contact clips having a pathway that accommodates at least selective linear displacement of a contact blade of the plurality of contact blades along the pathway. The contact clip can be in electrical communication with the fuse element via, at least in part, engagement of the contact blade with a portion of a wall of the contact clip defines at least a portion of the pathway.

Additionally, an aspect of the present application is an apparatus that includes an electronic apparatus having an enclosure, the enclosure having an interior region configured to receive a dielectric fluid. The apparatus can also include a tank flange that can be mounted to the enclosure and positioned about an opening in the enclosure. The tank flange can have an aperture and a plurality of guide openings. The apparatus can further include a cap that is configured for selective positioning about the tank flange and the opening of the enclosure. Additionally, the apparatus can include a fuse that can be coupled to the cap, the fuse comprising a fuse element encased within a sheath, the sheath comprising an electrically insulative material. The fuse element can include a sacrificial element that melts in response to overcurrent and opens at least a portion of a circuit that extends across the fuse. Additionally, the fuse can further comprise a plurality of contact blades that are in electrical communication with the fuse element, and which extend outwardly from at least the sheath. The apparatus can further include a plurality of contact clips that can be positioned within the interior region of the enclosure, each of the plurality of contact clips having a pathway that accommodates at least selective linear displacement of a contact blade of the plurality of contact blades along the pathway. The contact clip can be in electrical communication with the fuse element via, at least in part, engagement of the contact blade with a portion of a wall of the contact clip that defines at least a portion of the pathway. Further, each of the plurality of guide openings can be in linear alignment with an opening of the pathway of at least one of the plurality of contact clips.

These and other aspects of the present application will be better understood in view of the drawings and following detailed description.

BRIEF DESCRIPTION OF THE DRAWINGS

The description herein makes reference to the accompanying figures wherein like reference numerals refer to like parts throughout the several views.

Figure 1:
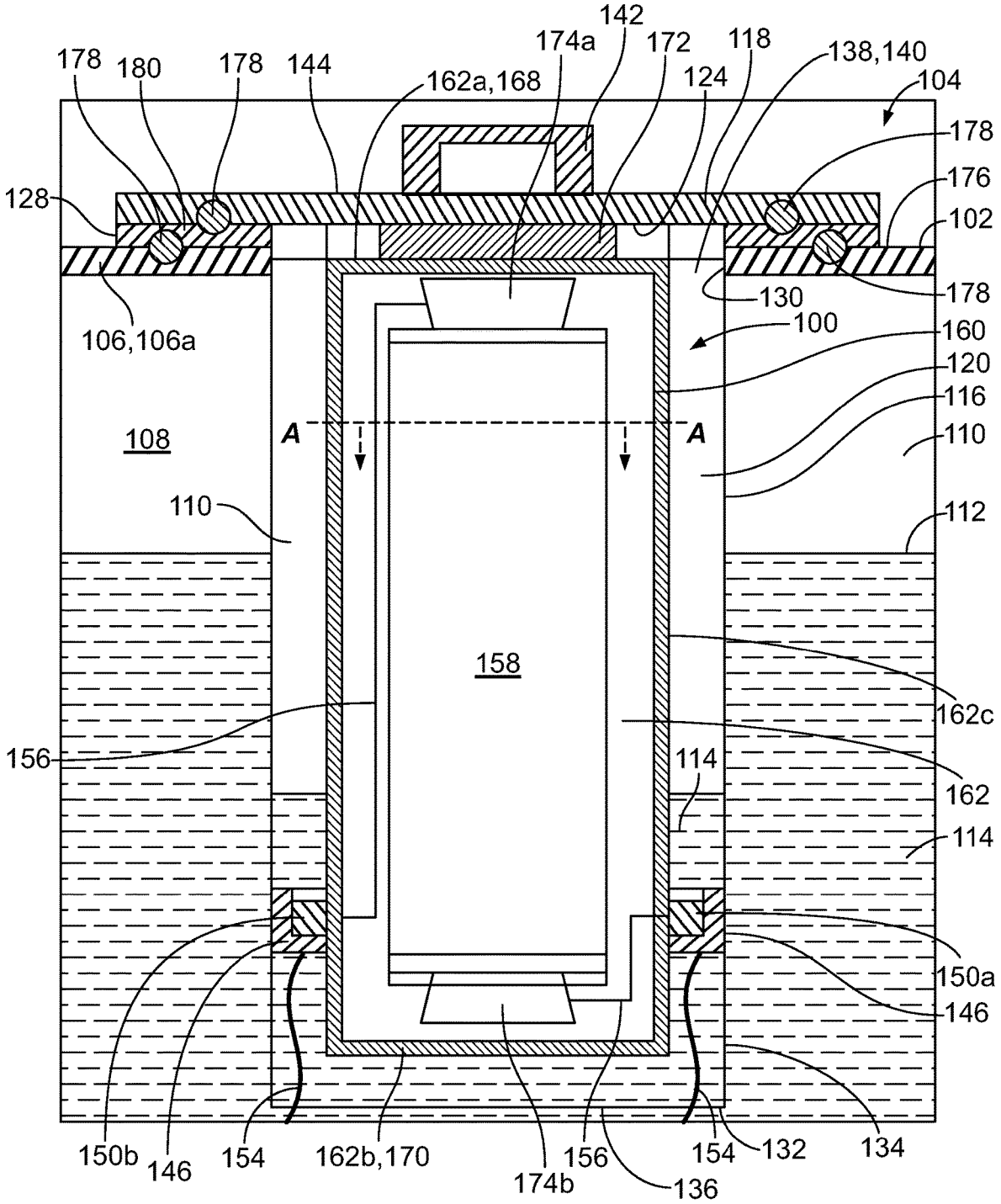
FIG. 1 illustrates a partial cross sectional side view of a draw-out current limiting fuse housed with an electronic apparatus according to an illustrated embodiment of the subject application.

The foregoing summary, as well as the following detailed description of certain embodiments of the present application, will be better understood when read in conjunction with the appended drawings. For the purpose of illustrating the application, there is shown in the drawings, certain embodiments. It should be understood, however, that the present application is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates a partial cross sectional side view of a draw-out current limiting fuse 100 housed within a tank or enclosure 102 of an exemplary electronic apparatus 104 according to an illustrated embodiment of the subject application. The draw-out current limiting fuse 100 of the subject application can be used with a variety of different types of electronic apparatuses, including, for example, but not limited to, a variety of different types of transformers. The enclosure 102 can also have a variety of different shapes and configurations. According to the illustrated embodiment, the enclosure 102 comprises one or more walls 106, such as, for example, a top wall 106*a*, sidewalls, and a bottom wall. Additionally, according to the illustrated embodiment, the wall 106 of the enclosure 102 defines an internal volume or interior region 108 of the enclosure 102 that houses a dielectric fluid, such as, for example, oil, as well as components of the electronic apparatus 104, including, for example, a core, and at least one coil assembly formed of high-voltage and low-voltage coil windings that can be mounted to the core (not shown). As shown by at least FIG. 1, according to certain embodiments, the interior region 108 of the enclosure 102 may, or may not, have a gas space 110 between a top level 112 of the dielectric fluid 114 and the inside surface of a wall 106, such as a top wall 106*a*, of the enclosure 102.

For example, according to certain embodiments, the electronic apparatus 104 is a transformer, such as, for example, a power transformer, a shunt reactor, or substation distribution transformer. Additionally, according to the application, the transformer can be single-phase or poly-phase, e.g. three-phase. Further, for example, according to certain embodiments, the transformer can provide converted electrical power at an output of the transformer to a power grid or load. According to certain embodiments, the power transformer is a step-up or step-down transformer, and the corresponding voltages and currents are increased or decreased, depending upon the application, via operation of the transformer. Additionally, the transformer can have a conservator for retaining dielectric fluid 114 provided to the interior region 108 and radiators for cooling the transformer during operation. Further, according to certain embodiments, the transformer can also be provided with high-voltage bushings and low-voltage bushings.

Figure 9:
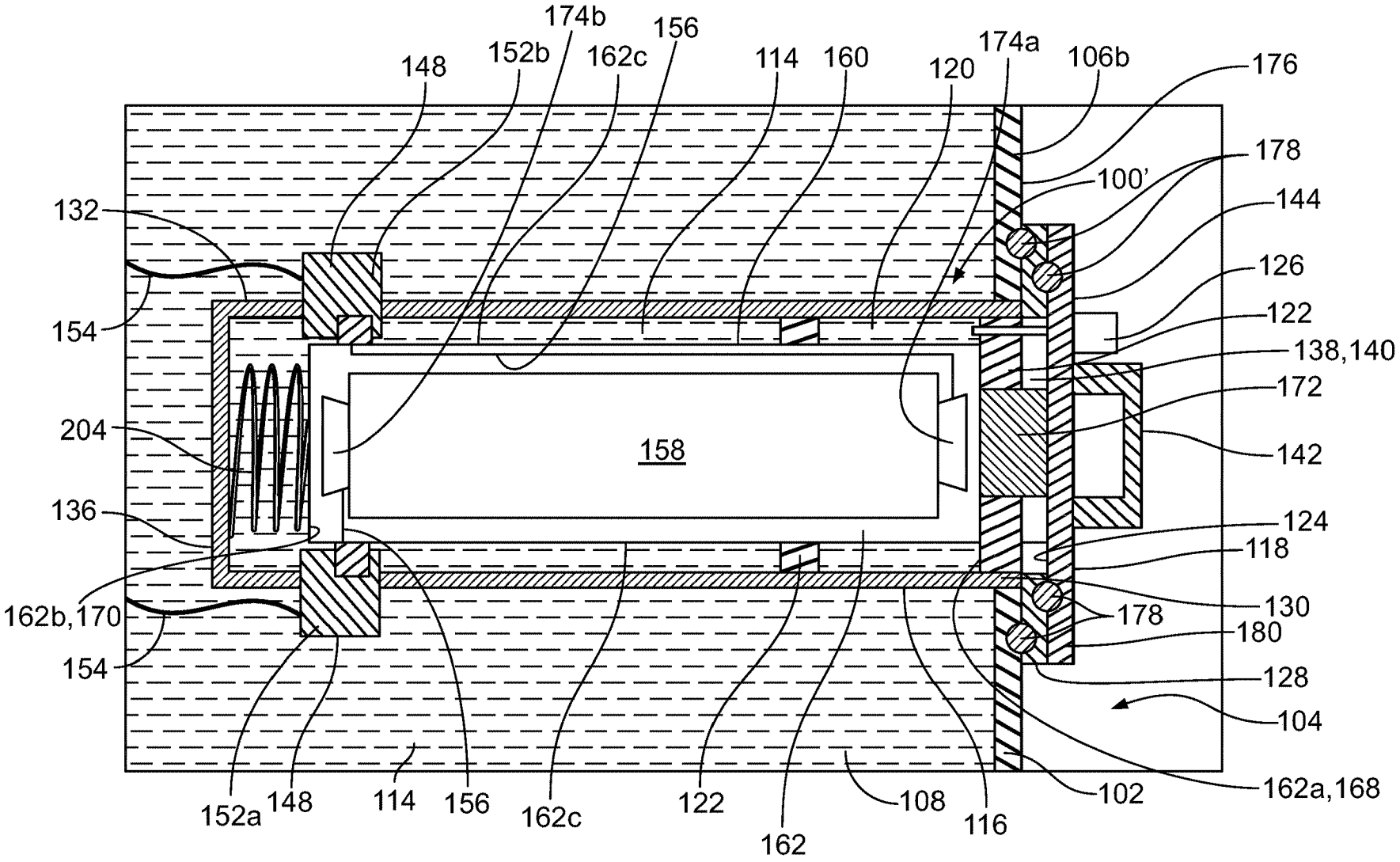
FIG. 9 illustrates a partial cross sectional side view of a draw-out current limiting fuse housed in a canister within an electronic apparatus and in a horizontal mounted orientation according to an illustrated embodiment of the subject application.

According to certain embodiments, the enclosure 102 includes a canister 116 that is configured to accommodate seating of at least a portion of the draw-out fuse 100 inside the enclosure 102 of the electronic apparatus 104. However, according to other embodiments, the draw-out fuse 100 may be placed within the interior region 108 of the enclosure 102 without use of a canister 116. According to the illustrated embodiment, the canister 116 is a tubular body that can have a variety of different shapes and sizes. The wall 106 of the enclosure 102 can be coupled to the canister 116 such that the canister 116 extends into the interior region 108 of the enclosure 102. Further, while FIG. 1 depicts the canister 116 extending vertically downward from the top wall 106*a* of the enclosure 102, the canister 116 can extend from other walls of the enclosure 102 and/or at a variety of angles, such as, for example, extend horizontally from a sidewall 106*b* of the enclosure 102, as shown in FIG. 9. Additionally, the canister 116 can extend at a variety of other angles from the enclosure 102, which can, in at least certain applications, be based on potential space constraints and/or space availability limitations within the interior region 108 of the enclosure 102. As shown by FIG. 9, with at least respect to such horizontal and other angular mounting orientations, one or more insulating rings 122 of appropriate dielectric strengths can be provided to prevent accidental grounding of the energized draw-out fuse 100 to the enclosure 102 and/or canister 116. According to the illustrated embodiment, an insulating ring 122 can be coupled to a bottom side 124 of a selectively removable cap 118 that is used to provide access into the interior region 108 of the enclosure 102 and/or a cavity 120 of the canister 116, as discussed below. Further, according to certain embodiments in which the canister 116 is filled entirely of dielectric fluid 114, as shown in FIG. 9, a mechanism is provide using a non-return valve 126 to fill the canister 116 with dielectric fluid 114 after securing the cap 118 to the canister 116, tank flange 128, and/or enclosure 102, as discussed below. In this manner, the non-return valve 126 can act as a unidirectional mechanism to fill the canister 116 and/or interior region 108 with dielectric fluid 114 from the outside of the enclosure 102.

According to the embodiment illustrated in FIG. 1, the first end 130 of the canister 116 is coupled to an adjacent portion of the wall 106 of the enclosure 102 such that the canister 116 is in fluid communication with an opening 140 in a cover or top wall 106 of the enclosure 102. The canister 116 can extend lineally between the first end 130 and a second end 132 of the canister 116. Further, the canister 116 can also include a sidewall 134 and an end wall 136 that can generally define the cavity 120 of the canister 116, the cavity 120 being sized to house at least a portion of the draw-out fuse 100, and the end wall 136 being positioned at the second end 132 of the canister 116. Additionally, the first end 130 of the canister 116 can include an opening 138 that is sized to accommodate insertion/removal of at least a portion of the draw-out fuse 100 into/from the cavity 120 of the canister 116. Further, the cavity 120 of the canister 116 can be sized, including extend at a length between the first and second ends of the canister 116, to accommodate placement of at least a portion of the draw-out fuse 100 within the cavity 120, as well as provide space that may accommodate any electrical clearance requirements for such portions of the draw-out fuse 100 when operated, including, for example, when operated under the dielectric fluid 114.

According to the illustrated embodiment, the canister 116 can further include, and/or be generally coupled to, the selectively removable cover or cap 118, such as, for example removable so as to provide access to the cavity 120 of the canister 116 and/or the interior region 108 of the enclosure 102. Further, according to certain embodiments, the cap 118 can be directly or indirectly coupled to the first end 130 of the canister 116 such that the cap 118 can selectively cover at least the opening 138 and/or cavity 120 of the canister 116. Further, in addition to, or in lieu of, being selectively directly or indirectly coupled to the canister 116, the cap 118 can be coupled to the enclosure 102 and/or a tank flange 128 that can be mounted to the enclosure 102 and/or positioned between the enclosure 102 and the cap 118. Additionally, according to certain embodiments, the cap 118 can be coupled to a handle 142, such as, for example, attached to a handle 142 that extends from an upper surface 144 of the cap 118, which can enhance the ease at which the cap 118 can displaced, including displaced generally linearly and/or rotationally.

Further, as discussed below, the canister 116 can be configured such that dielectric fluid 114 housed within the cavity 120 will generally remain within the canister 116, and thus be separated from other dielectric fluid within the interior region 108 of the enclosure 102 that is not within the canister 116. Moreover, the canister 116 can be configured such that dielectric fluid does not flow between the cavity 120 of the canister 116 and the other portions of the interior region 108 of the enclosure 102 that are outside of the canister 116. Thus, according to certain embodiments, additional dielectric fluids can be added to the cavity 120 of the canister 116. Further, the level of dielectric fluid within the cavity 120 of the canister 116 may or may not be at the same as the level of dielectric fluid that is within other portions of the interior region 108 of the enclosure 102.

Figure 10:
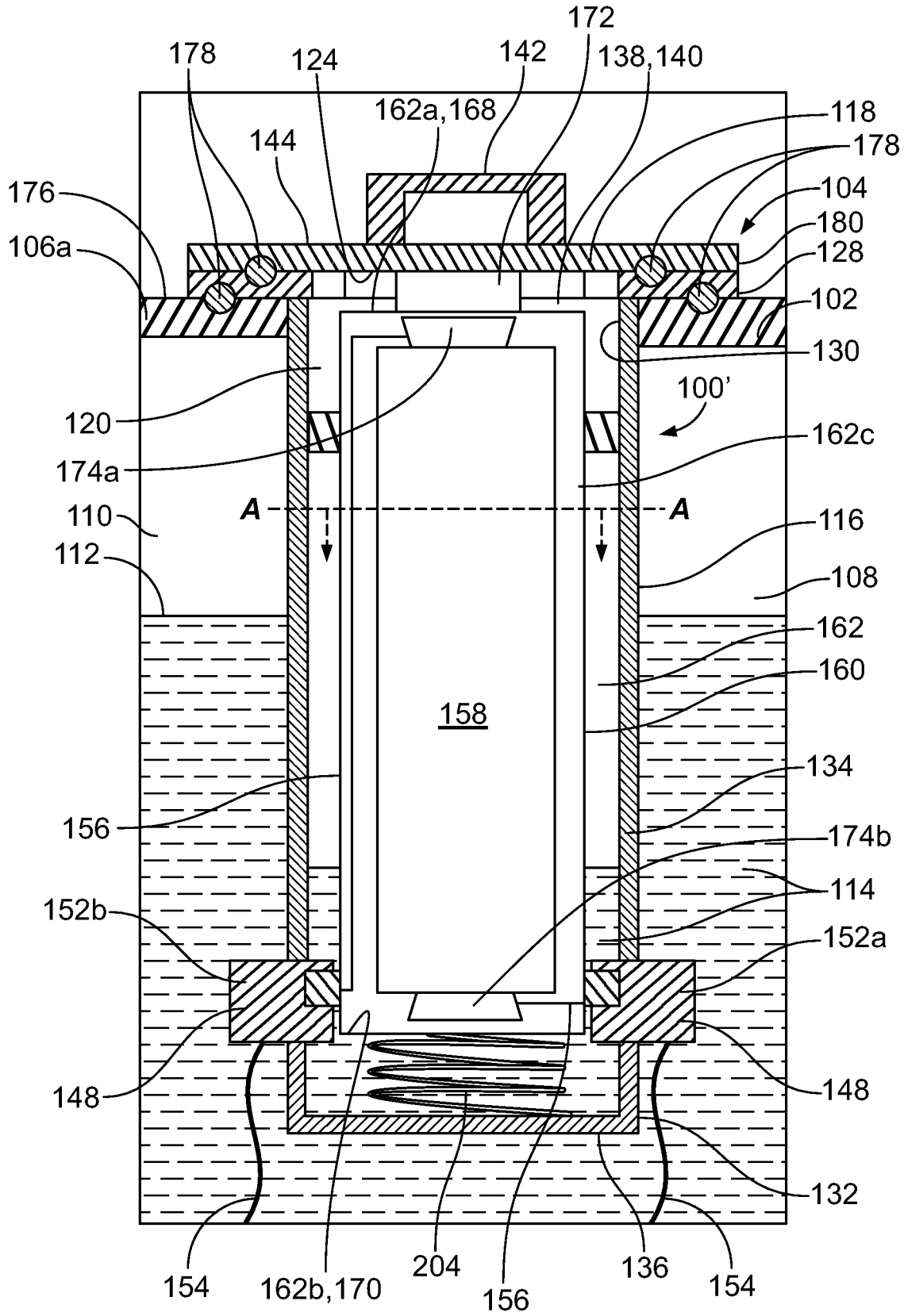
FIG. 10 illustrates a partial cross sectional side view of a draw-out current limiting fuse housed in a canister in an electronic apparatus according to an illustrated embodiment of the subject application.

As shown in at least FIGS. 1 and 9, the electronic apparatus 104 can include one or more electrical contact clips 146, 148 that are constructed from an electrically conductive material, including, for example, copper, aluminum, or steel, among other materials and/or combinations thereof. The contact clips 146, 148 are configured to be electrically coupled to an associated one or more contact blades 150*a-b*, 152*a-b* of the draw-out fuse 100, 100', as discussed below, as well as to one or more leads 154 of the electronic apparatus 104, such as, for example, leads 154 that are electrically coupled to a coil of a transformer. According to at least certain embodiments in which the electronic apparatus 104 includes a canister 116, at least a portion of the contact clips 146, 148 can extend from the sidewall 134 of the canister 116 and into the cavity 120 of the canister 116. Additionally, according to certain embodiments, at least a portion of the contact clips 146, 148 can outwardly extend away from an outer side of the sidewall 134 of the canister 116 and into at least dielectric fluid 114 that is contained within the interior region 108 of the enclosure 102 outside of the canister 116. Further, the draw-out fuses 100, 100' shown in at least FIGS. 1, 9, and 10 are suitable for retrofit applications, and additional dielectric fluid 114 can be provided inside the canister 116, as previously discussed.

Figure 2:
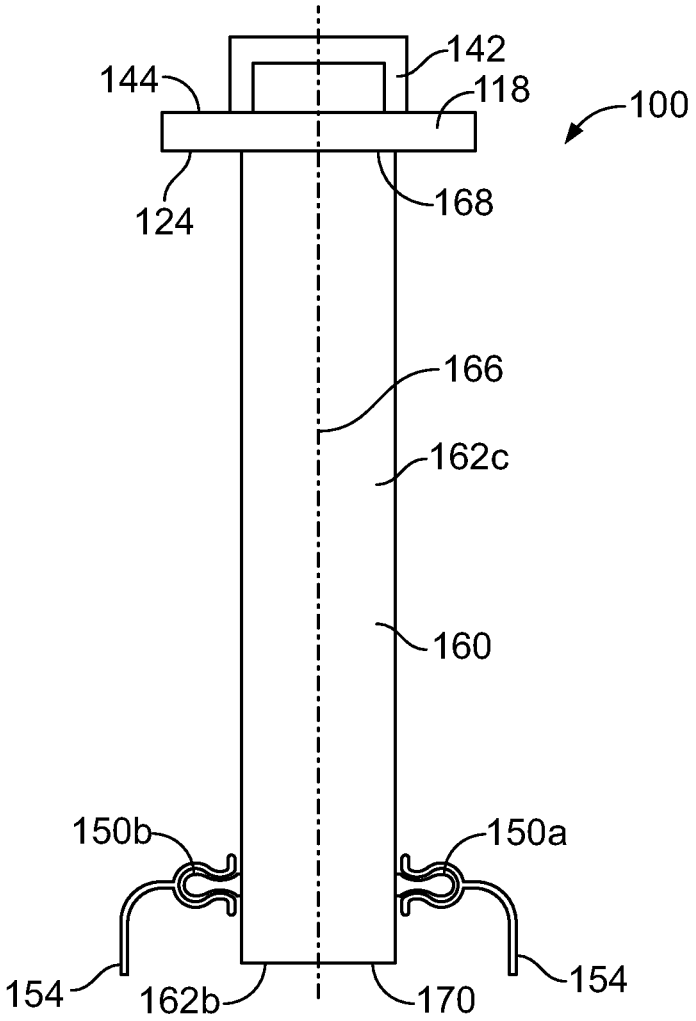
FIG. 2 illustrates a side view of a draw-out fuse having an electrically insulated encasing sheath that is attached to a cap, and which includes a pair of contact blades that are electrically coupled to a pair of leads of a component(s) of an electrical apparatus, according to an illustrated embodiment of the subject application.

The draw-out fuse 100 can include a fuse element 158 that is encased within an electrically insulative sheath 160, and can include one or more contact blades 150*a*, 150*b*. According to the illustrated embodiment, the draw-out fuse 100 is a current-limiting fuse and has a sacrificial element, such as, for example, the fuse element 158, that melts in response to overcurrent and opens the corresponding circuit. As shown in at least FIG. 2, according to certain embodiments, the draw-out fuse 100 can extend along a central axis 166 from a first end 168 to a second end 170 of the draw-out fuse 100. Further, according to certain embodiments, the draw-out fuse 100 can be sized to be housed within the cavity 120 of the canister 116, or otherwise positioned within at the interior region 108 of the enclosure 102. Moreover, according to certain embodiments, the fuse element 158 can be seated within the cavity 120 of the canister 116. As previously mentioned, the canister 116 and draw-out fuse 100 can be sized such that a dielectric clearance is provided between at least a portion of the draw-out fuse 100 and the walls 134, 136 of the canister 116.

The sheath 160 can be constructed from an electrically insulative material, and can be configured to encase the fuse element 158 within an inner area 162 of the sheath 160. Thus, according to certain embodiments, the sheath 160 can have an upper wall 164*a*, and lower wall 164*b*, as well as a sidewall 164*c* that extends therebetween, the upper, lower, and sidewalls 164*a-c* generally defining the inner area 162 of the sheath 160. The sheath 160 can also be coupled to, or other provide passage through the sheath 160 for, the contact blades 150*a*, 150*b*, as discussed below, as well as accommodate passage of electrical connections between the contact blades 150*a*, 150*b* and the fuse element 158, among other related connections therebetween. For example, according to the embodiments, the sheath 160 can be configured to accommodate fuse leads 156 that are in electrical contact with the fuse element 158 to extend to locations along, or through, the sheath 160 at which the fuse leads 156 can be electrically coupled to the contact blades 150*a*, 150*b*.

According to the illustrated embodiment, a portion of the draw-out fuse 100, such as, for example, a portion of the draw-out fuse 100 at or around a first end 168 of the draw-out fuse 100, can be coupled to the cap 118. Such a coupling and/or attachment to the cap 118 can facilitate the draw-out fuse 100 being able to be withdrawn from the cavity 120 upon displacement of the cap 118 away from at least the canister 116 and/or away from the interior region 108 of the enclosure 102. For example, according to certain embodiments, the cap 118 can be coupled to a locking mechanism 172 that can securely engage a portion of the draw-out fuse 100 in a manner that can secure the draw-out fuse 100 to the cap 118. More specifically, for example, according to certain embodiments, a portion of the locking mechanism 172 may exert a clamping force against the draw-out fuse 100, including the fuse element 158, and/or the cap 118, in a manner that can secure the draw-out fuse 100 to the cap 118. Alternatively, the locking mechanism 172 may engage one or both of the draw-out fuse 100 and/or the cap 118 via an interference fit, press fit, adhesive, and/or mechanical fastener(s), such, such as, for example, bolt, screw, or, pin, as well as any combinations thereof, in a manner that can secure the draw-out fuse 100 to the cap 118.

Figure 3:
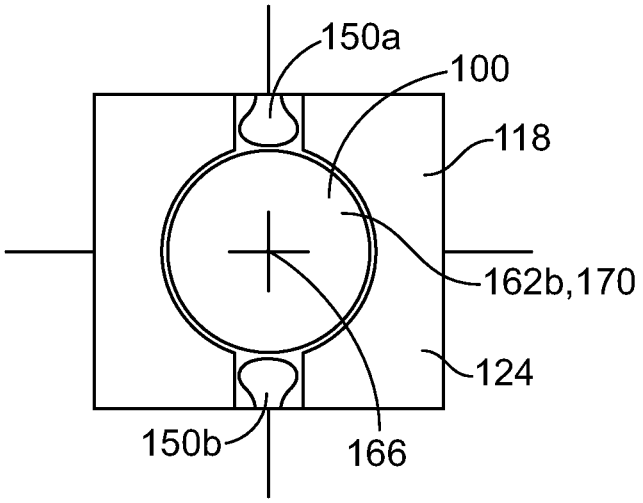
FIG. 3 illustrates a bottom side view of the draw-out fuse and the cap shown in FIG. 2.

As shown in at least FIGS. 1 and 3, according to certain embodiments, the one or more contact blades 150*a*, 150*b* can be electrically coupled to the fuse element 158, and extend outwardly from, or relative at least to, the insulative sheath 160. For example, according to certain embodiments, the one or more contact blades 150*a*, 150*b* can be outwardly extend from, or from around, a second end 170 of the draw-out fuse 100. Further, the contact blades 150*a*, 150*b* are configured to be electrically coupled to an adjacent contact clip 146. Additionally, as previously mentioned, according to certain embodiments, each contact blade 150*a*, 150*b*, which, similar to the contact clips 146, can be constructed from an electrically conductive material, can each be electrically coupled to a contact 174*a*, 174*b* of the fuse element 158, such as, for example, by a respective fuse lead 156. Further, according to certain embodiments, the contact blades 150*a*, 150*b* can be configured in a manner that can, when the contact blades 150*a*, 150*b* are connected to their respective contact clip 146, at least assist in retaining the draw-out fuse 100 inside the canister 116 and/or at a selected location or position within the interior region 108 of the enclosure 102.

According to certain embodiments, and as shown in at least FIG. 1, a level of dielectric fluid 114 inside the canister 116, and/or within the interior region 108, can be provided so that all of the direct electrically live contacts with the contact blades 150*a*, 150*b* are under dielectric fluid 114. Moreover, for example, according to certain embodiments, the cavity 120 of the canister 116 and/or interior region 108 of the enclosure 102 can be filled with a sufficient quantity of dielectric fluid 114 to at least engulf the engagement of the contact blade 150*a*, 150*b* with the adjacent contact clip 146 in the dielectric fluid 114, while the remainder of the cavity 120 and/or interior region 108 of the enclosure 102 outside of the contact between the contact blade(s) 150*a*, 150*b* and contact clip(s) 146 may, or may not, contain an air gap or gas space 110 between around other portions of the fuse element 158 and an adjacent surface of the wall 106 of the enclosure 102 and/or a bottom side 124 of the cap 118. Alternatively, according to other embodiments, the draw-out fuse 100 may be immersed entirely in dielectric fluid 114.

The tank flange 128 can be mounted along an outer side 176 of the wall 106 of the enclosure 102, and can configured for interfacing with the canister 116 and/or the cap 118. Moreover, according to certain embodiments, the tank flange 128 can be configured for a locking engagement with the cap 118 that can at least assist in retaining a position of the draw-out fuse 100 within the interior region 108 of the enclosure 102. Further, a seal, such as, for example, an O-ring 178, can be positioned between the interface between the tank flange 128 and the outer surface 176 of the wall 106 of the enclosure 102 so as to hermetically seal the contents of the enclosure 102, such as, for example, the interior region 108 of the enclosure 102 and/or cavity 120 of the canister 116, including, but not limited to, the dielectric fluid 114 contained therein. Additionally, or alternatively, an interface between the cap 118 and the tank flange 128, including, for example, an interface between a portion of the bottom side 124 of the cap 118 and an upper surface 180 of the tank flange 128 can utilize a seal, such as, for example, an O-ring 178, to also assist in hermetically sealing the contents of the enclosure 102.

Figure 4:
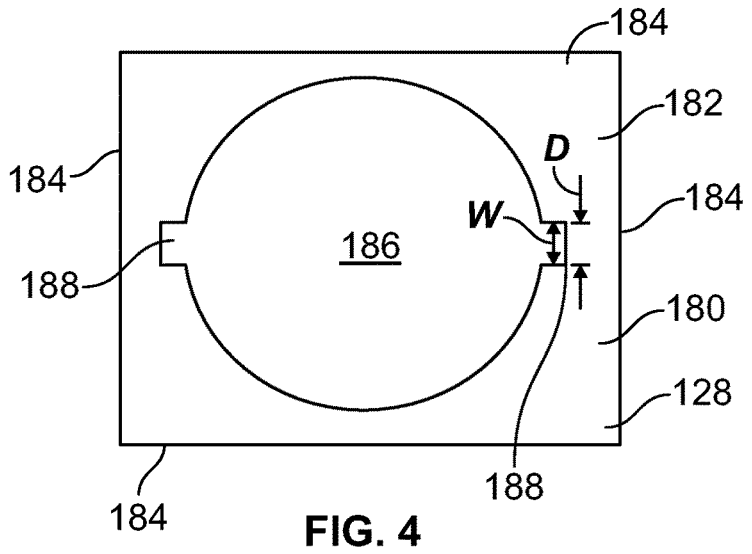
FIG. 4 illustrates a top side view of a tank flange configured to accommodate insertion of a draw-out fuse into a canister and/or interior region of an enclosure of an electronic apparatus at only certain relative angular orientations according to an illustrated embodiment of the subject application.

Referencing FIG. 4, the tank flange 128 can comprise a body 182 having a one or more outer sidewalls 184 that are sized to extend the tank flange 128 across the opening 140 in the in enclosure 102. The tank flange 128 can have a variety of shapes and configurations, such as, for example, round and non-round shapes, including but not limited to, circular, oval, square, and rectangular, among other shapes. Further, at least a portion of the tank flange 128 can be sized for secure, or locking, engagement with the cap 118. For example, according to certain embodiments, the tank flange 128 can include an internal and/or external thread that matingly engages a mating external or internal thread of the cap 118. According to other embodiments, the cap 118 can be mounted to the tank flange 128 via a press or interference fit, and/or via the use of one or more mechanical fasteners, including, for example, via one or more bolts, screws, and/or pins, as well as a combination thereof, among other connections.

Figure 6:
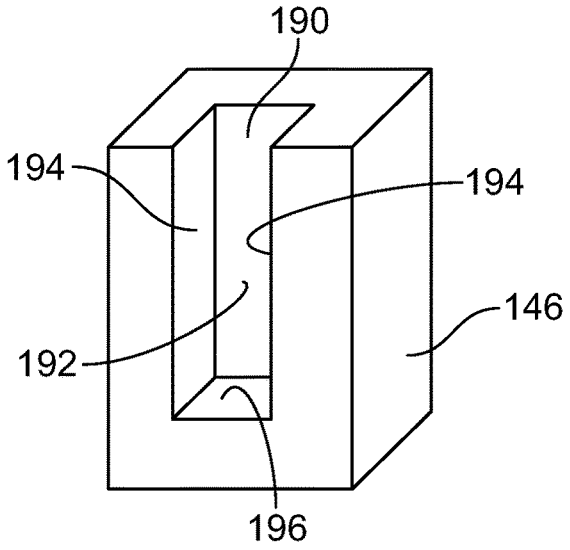
FIG. 6 illustrates a front side perspective view of an exemplary contact clip that is configured to be directly electrically coupled to a contact blade of a draw-out fuse according to an illustrated embodiment of the subject application.
Figure 11:
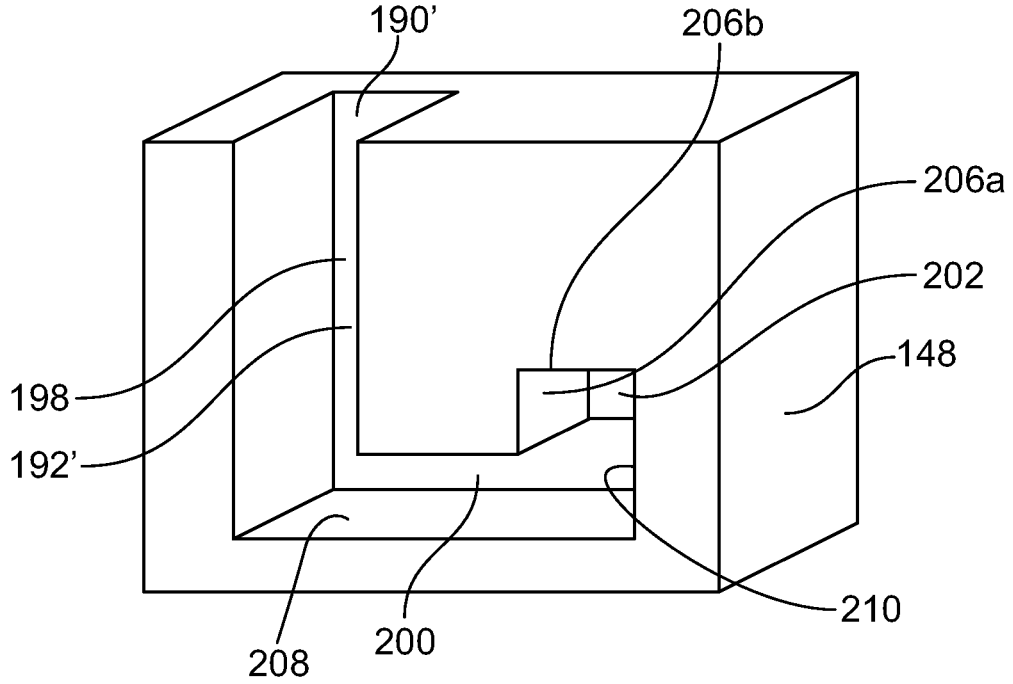
FIG. 11 illustrates a front side perspective view of an exemplary contact clip that is configured to be directly electrically coupled to a contact blade of a draw-out fuse via bayonet connection according to an illustrated embodiment of the subject application.
Figure 12:
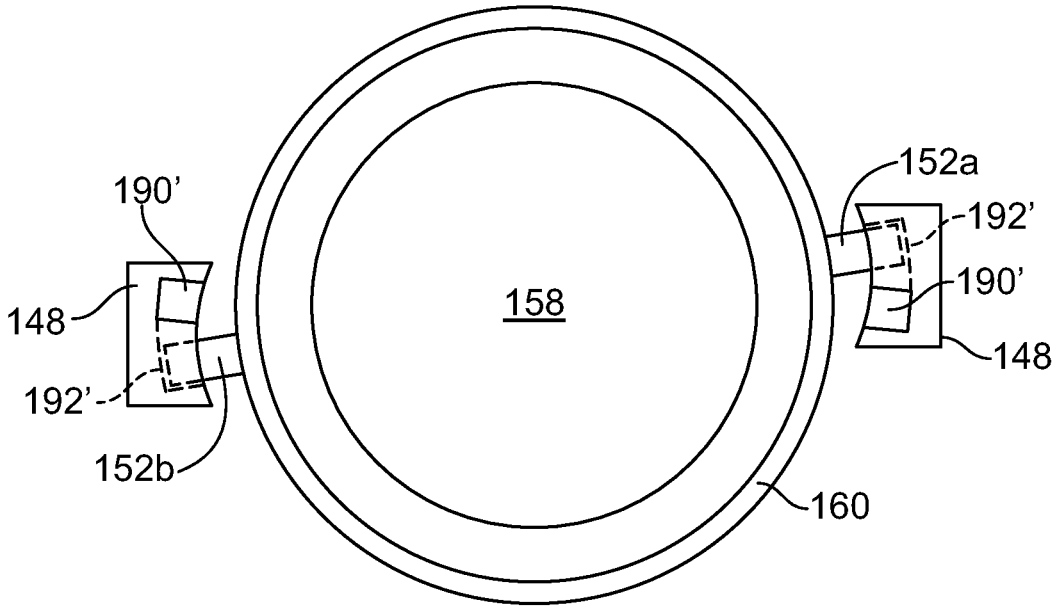
FIG. 12 illustrates a top side view of the draw-out current limiting fuse in engagement with a plurality, as shown from the plane indicated at A-A in FIG. 10 according to an illustrated embodiment of the subject application.

The tank flange 128 can also include an aperture 186 that is sized to accommodate displacement of at least a portion of the draw-out fuse 100 into, and out of, the interior region 108 of the enclosure 102, and/or the cavity 120 of the canister 116. The aperture 186 can include one or more guide openings 188 that extend outwardly from adjacent portions of the aperture 186, and which are sized and positioned to align a corresponding contact blade 150*a*, 150*b* of the draw-out fuse 100 in position to be received by a corresponding contact clip 146. For example, according to the illustrated embodiment, the aperture 186 includes a pair of guide openings 188 in the form of outwardly extending slots, each slot having a depth and width (as indicated by "D" and "W" in FIG. 4) that is sized to accommodate passage of at least a portion of an outwardly extending contact blade 150*a-b*, 152*a-b* of the draw-out fuse 100, 100'. Further, the guide openings 188 can be generally aligned with an opening 190, 190' of a pathway 192, 192' (FIGS. 6 and 11) in a mating contact clip 146, 148 such that continued linear displacement following passage of the contact blades 150*a-b*, 152*a-b* through a corresponding one of the guide openings 188 will deliver the contact blade 150*a-b*, 152*a-b* into the pathway 192, 192' in the contact clip 146, 148. Thus, the guide openings 188 can be configured to limit the rotational orientations about the central axis 166 of the draw-out fuse 100 that the draw-out fuse 100 can pass through the tank flange 128 and into the cavity 120 of the canister 116 and/or the interior region 108 of the enclosure 102.

While FIG. 4 depicts the guide openings 188 as being generally square or rectangular in shape, the guide openings 188 can have a variety of other shapes and configurations that can accommodate the shape and/or configuration of a corresponding contact blade 150*a-b*, 152*a-b*. Additionally, while FIG. 4 illustrates the guide openings 188 having similar shapes and sizes, at least one of the shape and/or size of one guide opening 188 can be different that the shape and/or size of the other guide opening 188. Accordingly, the shape and/or size of at least one contact blade 150*a*, 152*a* can be different that of another contact blade 150*b*, 152*b* so to further limit the angular orientation relative to the central axis 166 of the draw-out fuse 100 that the draw-out fuse 100 can pass through the tank flange 128. Such configurations can be used to further limit which particular contact clip 146, 148, and thus corresponding leads 154, 156, the contact blades 150*a-b*, 152*a-b* are to be generally be electrically connected and/or attached.

Figure 5:
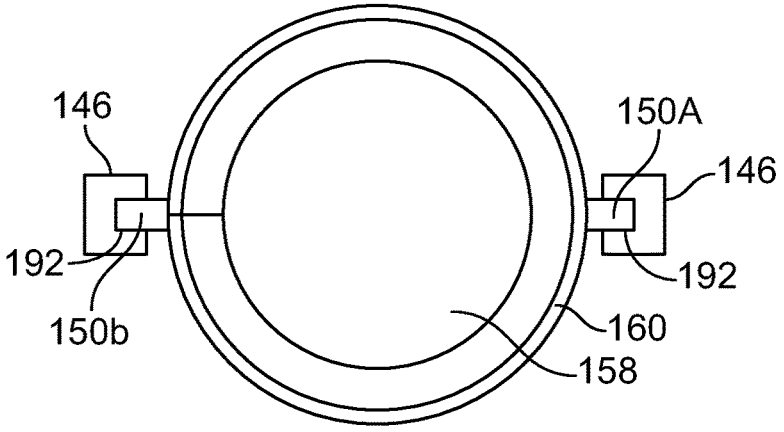
FIG. 5 illustrates a top side view of a draw-out current limiting fuse that is electrically coupled to contact clips, as shown from the plane indicated at A-A in FIG. 1 according to an illustrated embodiment of the subject application.

The contact blades 150*a-b*, 150*a-b* of the draw-out fuse 100, 100' as well as the associated contact clips 146, 148, can be configured for secure engagement in a variety of different manners. For example, as shown in at least FIGS. 1, 5, and 6, according to certain embodiments, the contact blade 150*a*, 150*b* can be linearly displaced along a linear pathway 192 of a mating contact clip 146 until the contact blade 150*a*, 150*b* reaches a bottom wall 196 of the pathway 192. Moreover, the contact blade 150*a*, 150*b* can be linearly displaced along the pathway 192 of the contact clip 146 until at least a portion of the contact blade 150*a*, 150*b* is seated, or otherwise bottoms out, at the bottom of the mating contact clip 146, at which location the contact blade 150*a*, 150*b* can be in a relatively secure electrical contact with adjacent portions of the contact clip 146. Further, according to certain embodiments, the contact blades 150*a*, 150*b* utilized for such a connection can extend radially outwardly from around the second end 170 of the draw-out fuse 100. Further, according to such an embodiment, the draw-out fuse 100 can include a pair of contact blades 150*a*, 150*b* that are positioned at diametrically opposite sides of the of the draw-out fuse 100. Additionally, according to certain embodiments, the pathway 192 can have a size(s) relative to the contact blades 150*a*, 150*b*, such as, for example, a size between opposing sidewalls 194 of the pathway 192 so that, at least when the contact blade 150*a*, 150*b* is seated within a mating contact clip 146, a portion of the sidewalls 194, as well as the bottom wall 196 of the pathway 192, are in direct contact with an adjacent portion of the contact blade 150*a*, 150*b*. Further, as previously mentioned, according to certain embodiments, the contact blades 150*a*, 150*b* can be configured in a manner that can, when the contact blades 150*a*, 150*b* are seated within the mating contact clip 146, at least assist in retaining the draw-out fuse 100 inside and/or at a selected location or position within the cavity 120 of the canister 116 and/or the interior region 108 of the enclosure 102. Further, as previously discussed, according to such an embodiment, each of the pathway 192 of the contact clips 146 can be aligned with a guide opening 188 of the tank flange 128 such that, after the contact blades 150*a*, 150*b* pass through the guide openings 188 of the tank flange 128, the continued linear displacement of the draw-out fuse 100 will deliver the contact blades 150*a*, 150*b* to the pathway 192 of the contact clips 146.

When the draw-out fuse 100 is to be replaced, the user may determine if there is an absence of positive pressure on the unit, including, for example, in the canister 116 or interior region 108 of the enclosure 102 before attempting to withdraw the draw-out fuse 100. The user can then grasp the handle 142 and linearly displaced the handle 142 and/or cap 118 so as to withdraw the draw-out fuse 100 from the interior region 108 of the enclosure 102 and/or the cavity 120 of the canister 116. The draw-out fuse 100 can then be detached from the locking mechanism 172 so as to be detached from the cap 118, or vice versa, and a new or replacement draw-out fuse 100 can then be secured to the cap 118 via the locking mechanism 172. Alternatively, the new or replacement draw-out fuse 100 can be accompanied by a new or replacement locking mechanism 172 and/or cap 118. The contact blades 150*a*, 150*b* of the new or replacement draw-out fuse 100 can then be aligned with the guide openings 188 of the tank flange 128 such that the draw-out fuse 100 can linearly displaced through the tank flange 128 in an orientation that is aligned with the opening 190 of the pathway 192, and continue to be linearly displaced into subsequent receipt in the pathway of the associated contact clip 146 until the contact blades 150*a*, 150*b* are seated within the corresponding contact clip 146, as previously discussed. Further, as previously discussed, with the contact blade(s) 152*a*, 152 be seated in the contact clip 146, the new or replacement draw-out fuse 100 can be retained in position via at least the engagement of the contact blades 152*a*, 152*b* with the contact clips 146.

Referencing FIGS. 9-12, according to other embodiments, the contact blades 152*a*, 152*b* of the draw-out fuse 100' and mating contact clips 148 can be configured to secure one or more of the contact blades 152*a*, 152*b* to a mating contact clip 148 via a bayonet connection. For example, according to certain embodiments, the draw-out fuse 100' can include a pair of contact blades 152*a*, 152*b* that are positioned at diametrically opposite sides of the of the draw-out fuse 100', and which are in a plane of the radius of the draw-out fuse 100', including, for example, of the sheath 160 and/or fuse element 158. Additionally, according to certain embodiments, the contact blades 152*a*, 152*b* can have a generally pin shape. According to certain embodiments, the pathway 192' of the contact clips 148 through which an adjacent contact blades 152*a*, 152*b* may travel can have a generally "L" shape, as shown for example, in at least FIG. 11. Thus, according to certain embodiments, the pathway 192' can include a first leg 198 and a second leg 200, the second leg 200 extending in a generally different direction than, and away from, the first leg 198. According to the embodiment shown in FIG. 11, the second leg 200 is generally perpendicular to the first leg 198, and terminates at an upwardly directed recess 202 that extends generally in a direction perpendicular to the second leg and toward a top surface of the contact clip 148. The recess 202 can be sized such that at least a portion of a wall 206*a* that defines the pathway 192' is positioned to prevent the contact blade 152*a*, 152*b* from traveling along the second leg 200 in a direction generally toward the first leg 198 of the pathway 192'. However, the pathway 192' of the contact clips 148 can have a variety of other shapes and configurations, including, for example, a second leg 200 that is non-perpendicular to the first leg 198 and diagonally extends away from first leg 198 in a generally partially upwardly and outwardly direction.

Additionally, as shown in FIGS. 9 and 10, according to certain embodiments that utilize a bayonet connection, a biasing element 204 can be provided that at least assists in retaining the contact blade 152*a*, 152*b* within the second leg 200 of the contact clip 148, including, for example, within the upwardly directed recess 202 of the second leg 200. According to embodiments that include a canister 116, the biasing element 204 can be placed in the cavity 120 along a bottom wall of the canister 116 such that, when the draw-out fuse 100' is inserted into the cavity 120 and pressed against the biasing element 204, the biasing element 204 exerts a force against the second end 170 of the draw-out fuse 100' that at least attempts to push the draw-out fuse 100' in the general direction of the opening 138 of the canister 116 and/or of the opening 140 of the enclosure 102.

According to the embodiments depicted in FIGS. 9-12, when the draw-out fuse 100' is to be connected to the contact clips 148, the contact blades 152*a*, 152*b* are aligned with the guide openings 188 of the tank flange 128 such that the draw-out fuse 100' can be linearly displaced in a first direction through the tank flange 128 and into the interior region 108 of the enclosure 102 and/or into the cavity 120 of the canister 116. The continued linear displacement of the draw-out fuse 100' in the first direction can deliver the contact blades 152*a*, 152*b* into the first leg 198 of a mating contact clip 148. According to embodiments that include the biasing element 204, the continued linear displacement of the contact blades 152*a*, 152*b* in a first direction and along at least a portion of the first leg 198 of a mating contact clip 148 to a bottom wall 208 of the pathway 192' beneath the first leg 198 can require that a sufficient force be provided to at least the draw-out fuse 100 to overcome the opposing biasing force of the biasing element 204. Moreover, as previously mentioned, the biasing force of the biasing element 204 can at least attempt to push the draw-out fuse 100 in a second, generally linear direction that is opposite of the first direction.

Upon one or both of the contact blades 152*a*, 152*b* reaching the bottom wall 208 of the first leg 198, or otherwise bottoming out within the pathway 192' of a contact clip 148, the draw-out fuse 100' can be rotated in a first rotational direction about the central axis 166 of the draw-out fuse 100'. Such rotation of the draw-out fuse 100' can be facilitated by use of the handle 142, which, as previously discussed, can be indirectly coupled to the draw-out fuse 100' via, for example, the cap 118 and associated locking mechanism 172. Such rotation can facilitate the rotational displacement of the contact blades 152*a*, 152*b* along the second leg 200 of the pathway 192' until the contact blades 152*a*, 152*b* reach an end wall 210 of the second leg 200. According to the illustrated embodiment, upon reaching the end wall 210 of the second leg 200, the user can release the handle 142, and the biasing element 204 can then push the draw-out fuse 100' in the second direction such that the contact blades 152*a*, 152*b* are displaced into upwardly directed recess 202 of the second leg 200, thereby securing the contact blades 152*a*, 152*b* with the contact clip 148. Such continued biasing force of the biasing element 204 and/or the configuration of the recess 202 of the second leg 200 can at least assist in retaining the contact blades 152*a*, 152*b* in engagement with the contact clip 148. Further, the contact blades 152*a*, 152*b* can be positioned within the recess 202 such that the contact blades 152*a*, 152*b* abut against one or more adjacent walls 206*a*, 206*b*, 210 of the contact clip 148 that define at least a portion of the pathway 192', thereby placing the contact blades 152*a*, 152*b* in electrical contact with the contact clip 148. Moreover, as previously mentioned, such engagement of the contact blades 152*a*, 152*b* with the contact clip 148 can at least assist in retaining the draw-out fuse 100' inside the canister 116 and/or at a selected location or position within the interior region 108 of the enclosure 102.

When the draw-out fuse 100' that is secured to contact clip 148 via a bayonet connection is to be replaced, the user may at least initially determine whether there is an absence of positive pressure on the unit, including, for example, in the canister 116 or interior region 108 of the enclosure 102, before attempting to withdraw the draw-out fuse 100. The user can then grasp the handle 142 and linearly displaced the handle 142 and/or cap 118 with sufficient force to overcome the biasing force of the biasing element 204, and thereby displace at least the fuse element in the first direction such that the contact blades 152*a*, 152*b* are removed from the recess 202 of the second leg 200 of the pathway 192'. The user may then, via use of the handle 142, rotate the draw-out fuse 100' in a second rotational direction about the central axis 166 of the draw-out fuse 100', the second rotational direction being opposite of the first rotational direction. Such rotation can rotatably displace the contact blades 152*a*, 152*b* along the second leg 200 until the contact blades 152*a*, 152*b* reach the first leg 198 of the pathway 192'. The user may then, again via use of the handle 142, linearly displace the draw-out fuse 100' in the second direction, and/or utilize the biasing force of the biasing element 204, such that the contact blades 152*a*, 152*b* pass through at least the first leg 198 of the pathway 192' of the corresponding contact clip 148, as well as through the guide opening 188 of the tank flange 128, thereby withdrawing the draw-out fuse 100' from the electronic apparatus 104. The draw-out fuse 100' can then be replaced, and a new or replacement draw-out fuse 100' can then be connected to the contact clips 148 in a manner similar to that previously discussed above with respect to the draw-out fuse 100 shown in at least FIG. 1.

Figure 7:
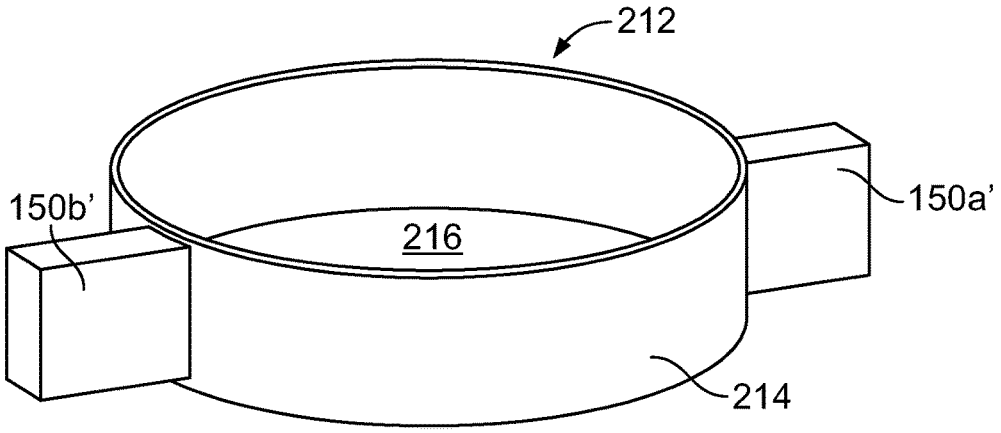
FIG. 7 illustrates a partial cutaway side view of a draw-out current limiting fuse coupled to a mounting ring and positioned within a canister in an electronic apparatus according to an illustrated embodiment of the subject application.
Figure 8:
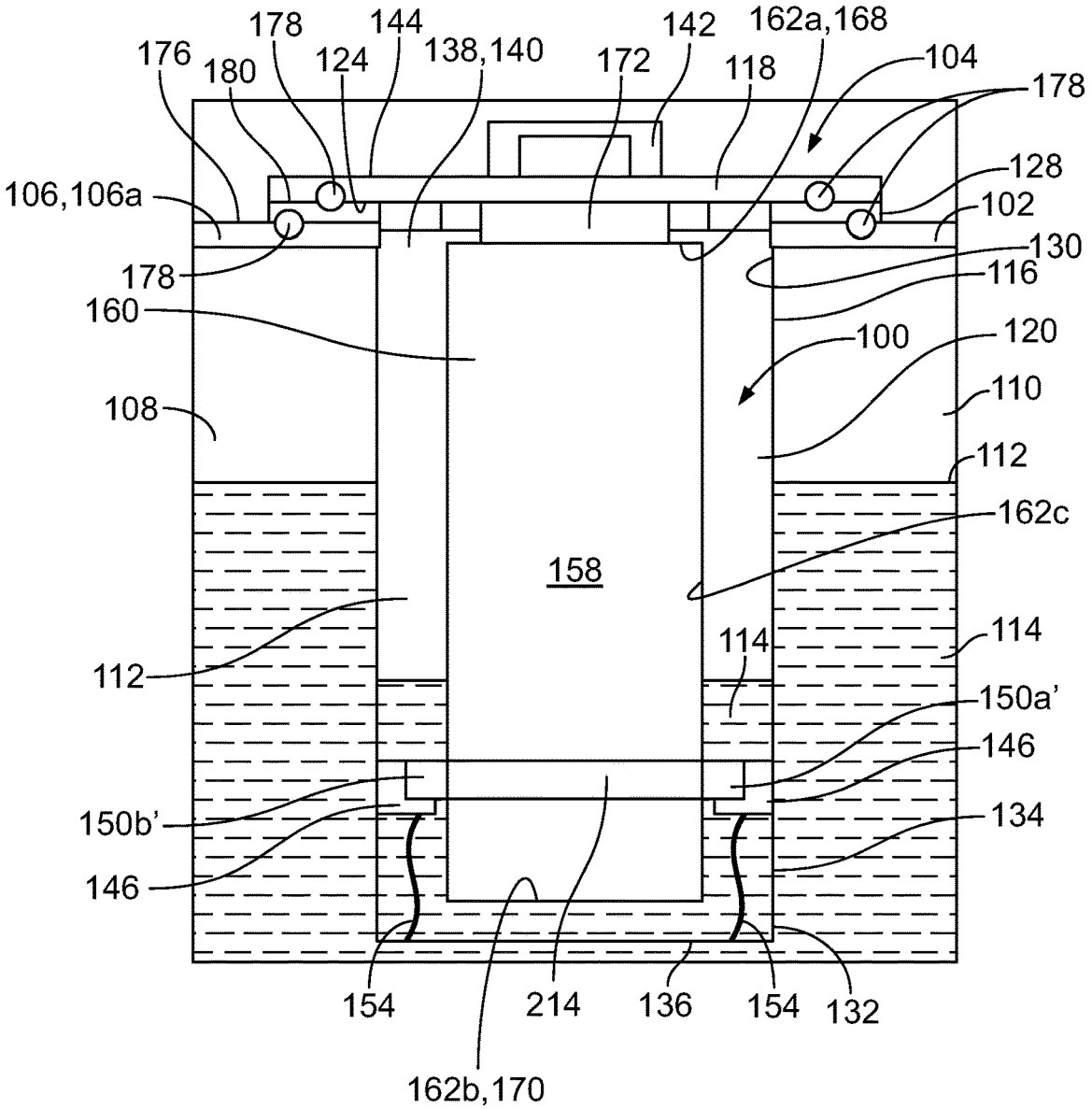
FIG. 8 illustrates a perspective view of a mounting ring for a draw-out fuse according to an illustrated embodiment of the subject application.
Figure 13:
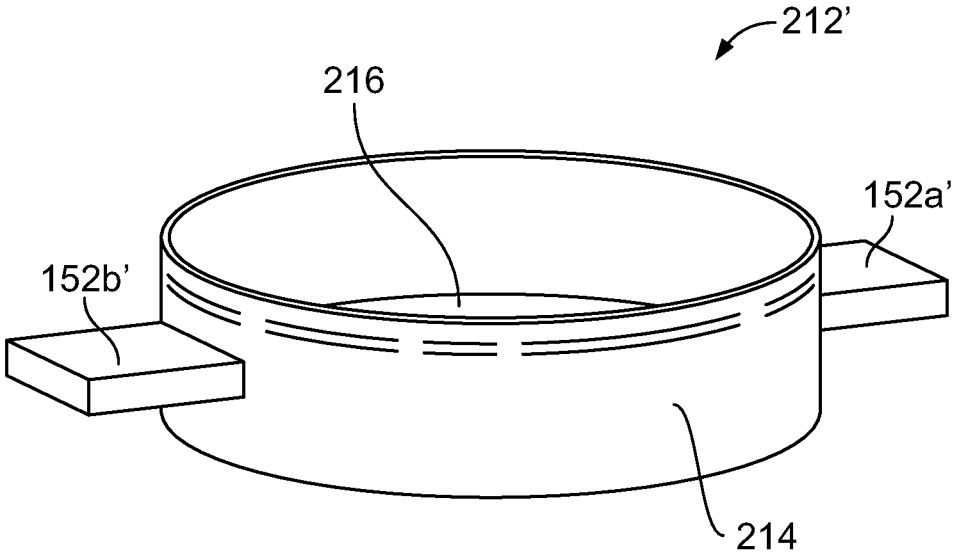
FIG. 13 illustrates a side perspective view of a mounting ring for a draw-out fuse according to an illustrated embodiment of the subject application.

Referencing FIGS. 7, 8, and 13, according to certain embodiments, the draw-out fuse 100, 100' can utilize a contact ring 212, 212'. According to such embodiments, the contact ring 212, 212' can include a body portion 214 having an aperture 216 that is sized to securely engage a second end 170 of the draw-out fuse 100, 100'. Further, according to the illustrated embodiment, the aperture 212 can be sized to be secured around an outer surface of the sheath 160. According to certain embodiments, the body portion 214 can be constructed from a generally electrically insulative material. Further, the body portion 214 can be coupled to contact blades 150*a'-b'*, 152*a'-b'*. Similar to the previously discussed contact blades 150*a-b*, 152*a-b*, each of the contact blades 150*a'-b'*, 152*a'-b'* of the contact ring 212, 212' can be electrically coupled to the fuse element 158, such as, for example, via a fuse lead 156. Additionally, the contact blades 150*a'-b'*, 152*a'-b'* of the contact ring 212, 212' can be connected to the contact clips 146, 148 in a variety of different manners, including, for example, in manners similar to those discussed above. For example, the contact ring 212 depicted in FIG. 7 can include a pair of contact blades 150*a'-b'* that are positioned at diametrically opposite sides of the of the contact ring 212, and which are sized to be received within the pathway 192 of, and matingly engage, the contact clip 146 depicted in at least FIG. 6 in manner similar to that discussed above with respect to at least FIGS. 1, 5, and 6. Additionally, for example, the contact ring 212' depicted in FIG. 13 can include a pair of contact blades 152*a'-b'* having a shape and/or configuration that can be received within the pathway 192' of, and matingly engage, the contact clip 148 depicted in at least FIG. 11 in manner similar to that discussed above with respect to at least FIGS. 9-12.

The draw-out fuse 100, 100' discussed above can be replaced while the electronic apparatus 104 is already down due to a blown fuse element 158. Alternatively, the electronic apparatus 104 can be taken offline, and the draw-out fuse 100, 100' can be relatively quickly replaced. The status as to whether the draw-out fuse 100, 100' has operated, or is blown, can be monitored in a variety of different manners, including, for example, by a resistance meter across the e draw-out fuse 100, 100' or other related components.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A draw-out fuse comprising:

a sheath comprising an insulative material;

a fuse element encased within the sheath, the fuse element including a sacrificial element that is configured to melt in response to overcurrent and open at least a portion of a circuit that extends across the draw-out fuse; and a plurality of contact blades in electrical communication with the fuse element and extending outwardly from at least the sheath, wherein the plurality of contact blades comprise a first contact blade electrically coupled to a first contact of the fuse element and a second contact blade directly electrically coupled to a second contact of the fuse element, the first and second contact blades extending outwardly from diametrically opposite sides of the sheath, and wherein the first and second contact blades extend along a common plane that is parallel to a radius of the sheath and that is perpendicular to a central axis of the draw-out fuse.

2. The draw-out fuse of claim 1, wherein the first contact blade is directly electrically coupled to the first contact of the fuse element by a first fuse lead, and the second contact blade is directly electrically coupled to the second contact of the fuse element by a second fuse lead.

3. The draw-out fuse of claim 1, wherein the draw-out fuse extends between a first end and a second end of the draw-out fuse along the central axis of the draw out fuse, and wherein the plurality of contact blades extend radially outwardly around the second end of the draw-out fuse.

4. The draw-out fuse of claim 3, further including a cap and a locking mechanism, the locking mechanism configured to securely couple the first end of the draw-out fuse to the cap.

5. The draw-out fuse of claim 4, wherein the cap is coupled to a handle.

6. The draw out fuse of claim 1, wherein the plurality of contact blades have a pin configuration.

7. An apparatus comprising:

a fuse comprising a fuse element encased within a sheath, the sheath comprising:

an electrically insulative material, the fuse element including a sacrificial element that is configured to melt in response to overcurrent and open at least a portion of a circuit that extends across the fuse, and wherein the fuse further comprises a plurality of contact blades in electrical communication with the fuse element and extending outwardly from at least the sheath; and a plurality of contact clips, each of the plurality of contact clips having a pathway that accommodates at least selective linear displacement of a contact blade of the plurality of contact blades along the pathway, the contact clip being in electrical communication with the fuse element via, at least in part, engagement of the contact blade with a portion of a wall of the contact clip defines at least a portion of the pathway.

8. The apparatus of claim 7, further including a tank flange having an aperture and a plurality of guide openings, the tank flange configured to mount to an enclosure, each of the plurality of guide openings being size to accommodate passage of at least one of the plurality of the contact blades through the tank flange as other portions of the fuse are linearly displaced through the aperture.

9. The apparatus of claim 8, wherein each of the plurality of guide openings are positioned about the tank flange to align with an opening of the pathway of at least one of the plurality of contact clips.

10. The apparatus of claim 7, wherein the pathway of each contact clip of the plurality of contact clips extends linearly from an open end of the pathway to a bottom wall of the pathway, and wherein each contact blade of the plurality of contact blades is configured to be seated upon the bottom wall such that the contact blade is in electrical communication with the contact clip.

11. The apparatus of claim 10, wherein the plurality of contact blades are configured to retain a position of the fuse relative to at least one of the contact clips when the contact blade is seated upon the bottom wall.

12. The apparatus of claim 7, wherein the pathway of each contact clip of the plurality of contact clips is configured for a bayonet connection with a contact blade of the plurality of contact blades.

13. The apparatus of claim 12, wherein the pathway includes a first leg and a second leg, the second leg extending in a direction that is different than, and away from, the first leg.

14. The apparatus of claim 7, wherein the plurality of contact clips are secured to a canister, and wherein the fuse is positioned within a cavity of the canister.

15. The apparatus of claim 14, wherein the fuse extends between a first end and a second end, the plurality of contact blades being positioned around the second end of the fuse, and further including a dielectric fluid contained within the canister, the dielectric fluid having a fluid level within the cavity that covers the plurality of contact blades positioned within the cavity but which provides an air gap between at least a portion of a distance between the plurality of contact blades and the first end of the fuse.

16. The apparatus of claim 7, further comprising:

an electronic apparatus having an enclosure, the enclosure having an interior region configured to receive a dielectric fluid;

a tank flange mounted to the enclosure and positioned about an opening in the enclosure, the tank flange having an aperture and a plurality of guide openings; and a cap configured for selective positioning about the tank flange and the opening of the enclosure;

wherein the fuse is coupled to the cap, wherein the plurality of contact clips are positioned within the interior region of the enclosure, and wherein each of the plurality of guide openings is in linear alignment with an opening of the pathway of at least one of the plurality of contact clips.

17. The apparatus of claim 16, further including a canister, at least a portion of the canister positioned within the interior region, at least a portion of the fuse being positioned within a cavity of the canister, and further including a dielectric fluid contained within the canister, the dielectric fluid having a fluid level within the cavity that covers the plurality of contact blades positioned within the cavity but also provides an air gap around another portion of the fuse.

18. The apparatus of claim 16, wherein the electrical apparatus is a transformer, and wherein the pathway of each contact clip of the plurality of contact clips is configured for a bayonet connection with a contact blade of the plurality of contact blades.

19. The apparatus of claim 16, wherein the electrical apparatus is a transformer, and wherein the pathway of each contact clip of the plurality of contact clips is configured for a bayonet connection with a contact blade of the plurality of contact blades.

20. The apparatus of claim 7, wherein the pathway of each contact clip of the plurality of contact clips is configured for a bayonet connection with a contact blade of the plurality of contact blades.

21. The apparatus of claim 20, wherein the pathway includes a first leg and a second leg, the second leg extending in a direction that is different than, and away from, the first leg.

22. An electronic apparatus comprising:

an enclosure, the enclosure having an interior region configured to receive a dielectric fluid; and a plurality of contact clips positioned within the interior region of the enclosure, each of the plurality of contact clips having a pathway that accommodates at least selective linear displacement of a contact blade of a plurality of contact blades of a fuse along a pathway, the plurality of contact blades comprising a first contact blade electrically coupled to a first contact of the fuse and a second contact blade electrically coupled to a second contact of the fuse, wherein the plurality of contact blades extend outwardly from at least a sheath of the fuse encasing a fuse element of the fuse, wherein each contact clip is configured to be in electrical communication with the fuse element via, at least in part, engagement of a respective contact blade with a portion of a wall of the contact clip that defines at least a portion of the pathway, wherein the plurality of contact clips comprise a first contact clip configured to be in electrical communication with the first contact blade and a second contact clip configured to be in electrical communication with the second contact blade, and wherein the first contact clip and the second contact clip are in a common plane that is perpendicular to a central axis of the enclosure.

* * * * *